United States Patent [19]

Sugiyama et al.

[11] Patent Number: 4,833,988

[45] Date of Patent: May 30, 1989

[54] INKING DEVICE FOR PRINTING APPARATUS

[75] Inventors: Hiroyuki Sugiyama; Tatsuo Komori; Hiroshi Takamatsu, all of Toride, Japan

[73] Assignee: Komori Printing Machinery Co., Ltd., Tokyo, Japan

[21] Appl. No.: 141,104

[22] Filed: Jan. 5, 1988

[30] Foreign Application Priority Data

Jan. 12, 1987 [JP] Japan ..... 62-003252

[51] Int. Cl.[4] ..... B41F 31/00; B41F 31/30

[52] U.S. Cl. ..... 101/349; 101/352; 101/76; 101/247; 101/206

[58] Field of Search ..... 101/206, 207, 247, 352, 101/350, 351, 349, 208, 210, 202, 76, 75, 74, 77, 84, 85, 91, DIG. 6, 348

[56] References Cited

U.S. PATENT DOCUMENTS

| | | | |
|---|---|---|---|
| 1,746,523 | 2/1930 | Claybourn et al. | 101/351 |
| 1,911,048 | 5/1933 | Adsit et al. | 101/351 |
| 1,919,462 | 7/1933 | Claybourn | 101/351 |
| 1,952,028 | 3/1934 | Hehle et al. | 101/351 |
| 3,935,815 | 2/1976 | Keijser | 101/247 |
| 4,222,325 | 9/1980 | Edwards | 101/351 |
| 4,397,237 | 8/1983 | Makosch | 101/352 |
| 4,729,307 | 3/1988 | Harrison et al. | 101/350 |

*Primary Examiner*—Edgar S. Burr
*Assistant Examiner*—Kimberly Asher
*Attorney, Agent, or Firm*—Rosen, Dainow & Jacobs

[57] ABSTRACT

An inking device for a printing apparatus, comprising a form roller disposed in the printing apparatus main unit parallel to a printing shaft and rotatably contacting with the outer peripheral surface of a printing member mounted on the printing shaft, and an ink feed unit detachably mounted on the printing apparatus main unit and having a distributor roller rotatably contacting the outer peripheral surface of the form roller to supply the form roller with ink when the ink feed unit is mounted on the printing apparatus main unit, which can always provide an adequate nip pressure irrespective of movement of the printing shaft or mounting/removal of the ink feed unit.

6 Claims, 9 Drawing Sheets

FIG. 6
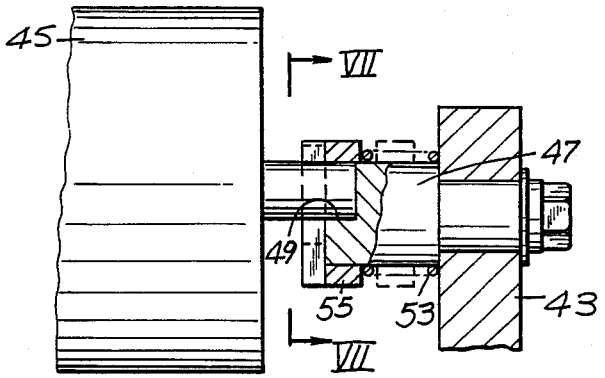
FIG. 7
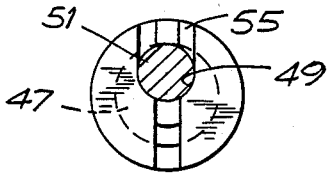
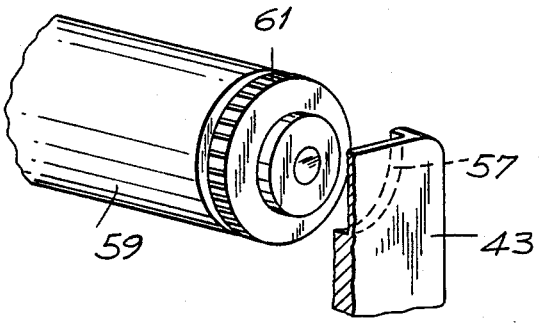
FIG. 8

INKING DEVICE FOR PRINTING APPARATUS

BACKGROUND OF THE INVENTION

1. Field of the Invention

This invention relates to an inking device for supplying ink to a numbering device or a relief imprinting cylinder attached, for example, to a sheet-feed offset printing apparatus.

2. Description of the Prior Art

FIG. 11 is a schematic view showing the entire structure of a prior art sheet-feed offset printing apparatus. Referring to FIG. 11, numeral 1 indicates a plate cylinder, numberal 3 indicates a blanket cylinder, number 5 indicates an impression cylinder, numeral 7 indicates an inker for plate cylinder, number 9 indicates a sheet feeder, and numeral 11 indicates a delivery station. A line pattern transferred from the plate cylinder 1 to the blanket cylinder is imprinted on a sheet of paper supplied from the sheet feeder 9 into and between the blanket cylinder 3 and the impression cylinder 5, and the printed sheet is discharged by the delivery station 11. Further, a number printing unit 17 comprising a numbering device 13 and its ink unit 15 is disposed between the impression cylinder 5 and the delivery station 11, and the sheet discharged from between the blanket cylinder 3 and the impression cylinder 5 is number printed.

Heretofore, in most small-size printing apparatus, the number printing unit 17 is detachably mounted on a printing apparatus main unit 19, and the detaching configuration includes the following two types. In a first type, referring to FIG. 12, the ink unit is configured as a unit so that a numbering shaft 23 and ink unit 15 can be independently attached and detached. In a second type, referring to FIG. 13, the numbering shaft 23 and ink unit 15 are integrally configured into a unit so that the numbering shaft 23 and the ink unit 14 can be attached and detached all at once.

However, the above-described prior art apparatus has had the following problems. First, when adjusting the nip pressure (contact pressure) of a form roller 18, which applies ink to the numbering device 13, there is only a small working space since a distributor roller 21 is disposed closely, which considerably deteriorates the workability of adjustment. In particular, in the first type which has the numbering shaft 23 and the ink unit 15 separately disposed, the nip pressure adjustment must be performed at every mounting of the ink unit 15 on the main unit 19, which leads to an increased preparation time for printing.

Moreover, when the thickness of a sheet to be printed varies, the distance between the centers of the impression cylinder 5 and the numbering shaft (printing shaft) 23 supporting the numbering device 13 must be varied according to the thickness. In such a case, when the center of the numbering shaft 23 is moved, the nip pressure of the form roller 18 to the numbering device 13 is varied, and therefore the nip pressure must be readjusted.

Further, if, as a result of test printing, the mounting position of the numbering device 13 relative to the numbering shaft 23 is to be varied, the ink unit must be removed in the prior art device of FIG. 12. In the prior art device of FIG. 13 in which the numbering shaft 23 and the ink unit 15 are integrally disposed, the entire unit must be removed. Therefore, various adjustments must be made again after the removed components are replaced.

On the other hand, when final printing is completed or when printing operation must be interrupted during final printing, for example, due to a problem in the paper feed, and the rollers must be idled, the distance between the centers of the impression cylinder 5 and the numbering shaft 23 must be expanded in order to prevent adherence of ink onto the impression cylinder 5. However, if the numbering shaft 23 is moved in the direction away from the impression cylinder 5, the numbering shaft 23 is consequently brought closer to the form roller 18, which increases the nip pressure of the form roller 18 to the numbering device 13. This can result in a change in the concentration of the ink or, in an extreme case, the rubber-made form roller 18 may be damaged.

Although the above description is for the case of number printing, the conditions are the same in the case of an imprinting. When a relief printing cylinder is used in place of the numbering device 13 and is attached to a printing shaft which corresponds to the numbering shaft 23, the imprinting operation can be performed.

SUMMARY OF THE INVENTION

With a view to solve all of the problems of prior art printing apparatus, it is a primary object of the present invention to provide an inking device for use in a printing apparatus, which allows an adequate nip pressure of the form roller to always be obtained irrespective of the movement of the printing shaft associated with, for example, adjustment to the thickness of the print paper.

In accordance with the present invention which attains the above object, there is provided an inking device for use in a printing apparatus having a printing shaft disposed in the vicinity of an impression cylinder in a main unit of the printing apparatus and driven to rotate in synchronization with the impression cylinder for printing by a printing member mounted on the printing shaft and an object to be printed inserted between the impression cylinder and the printing member, comprising a form roller disposal in the main unit of the printing apparatus parallel to the printing shaft and rotatably contacting the outer peripheral surface of the printing member, and an ink feed unit detachably mounted on the main unit of the printing apparatus and having a distributor roller rotatably contacting the outer peripheral surface of the form roller to supply the form roller with ink when the ink feed unit is mounted on the main unit of the printing apparatus.

In the inking device for a printing apparatus according to the present invention, when the ink feed unit is mounted on the main unit of the printing apparatus, the distributor roller of the ink feed unit comes into contact with the form roller of the main unit of the printing apparatus, and ink is supplied from the distributor roller to the form roller. Ink is then coated by the form roller onto the printing member to perform printing. The form roller, irrespective of attachment or detachment of the ink feed unit, is always maintained at a position relative to the printing member, and therefore the nip pressure of the form roller is not affected by movement of the printing shaft.

Other and further objects of this invention will become obvious upon an understanding of the illustrative embodiment about to be described or will be indicated in the appended claims, and various advantages not referred to herein will occur to one skilled in the art upon employment of the invention in practice.

BRIEF DESCRIPTION OF THE DRAWINGS

FIG. 6 is an enlarged sectional view of a supporting section of a form roller.

FIG. 7 is a sectional view taken along line VII—VII of the form roller.

FIG. 8 is a partly broken enlarged perspective view of an end of a lever.

DESCRIPTION OF THE PREFERRED EMBODIMENT

Figure 1:
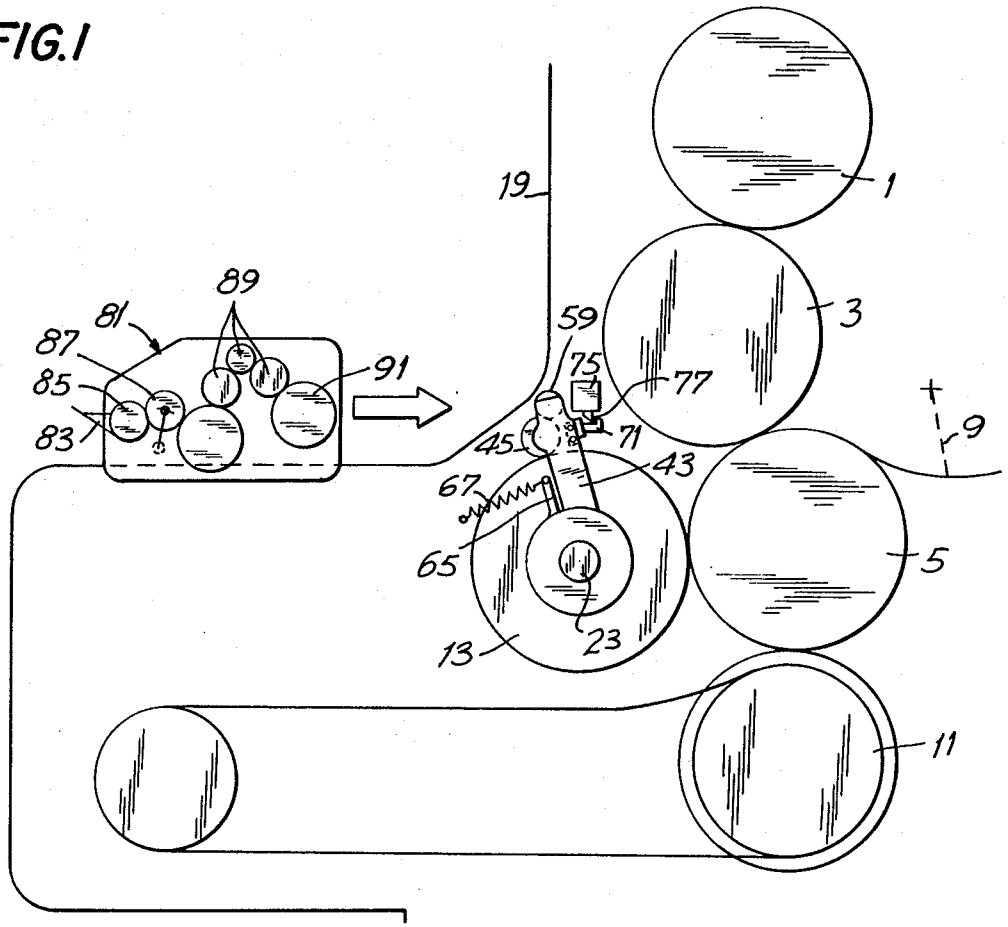
FIG. 1 is a schematic view showing part of a printing apparatus using an embodiment of the present invention.
Figure 2:
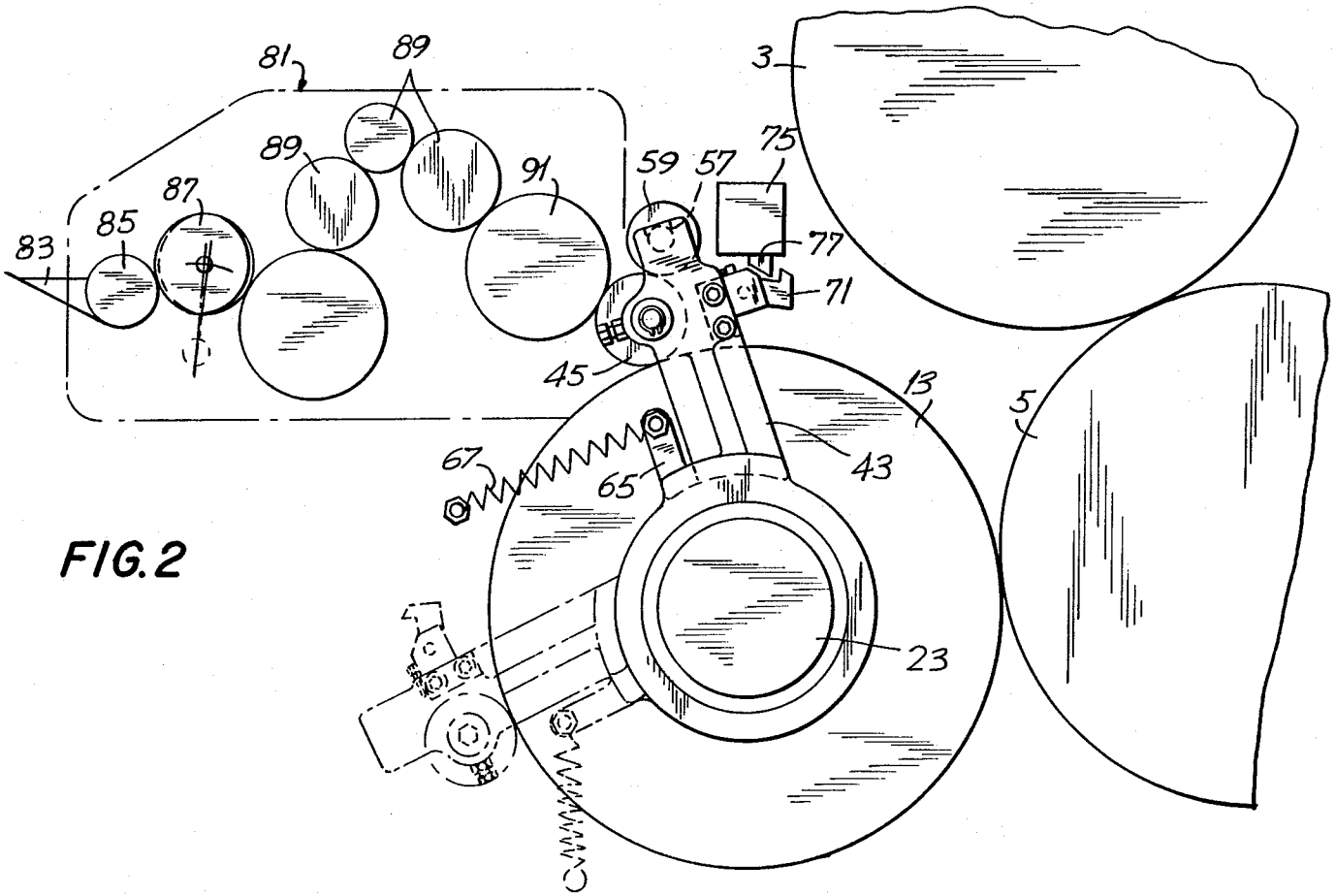
FIG. 2 is an enlarged view of part of the printing apparatus in FIG. 1.
Figure 3:
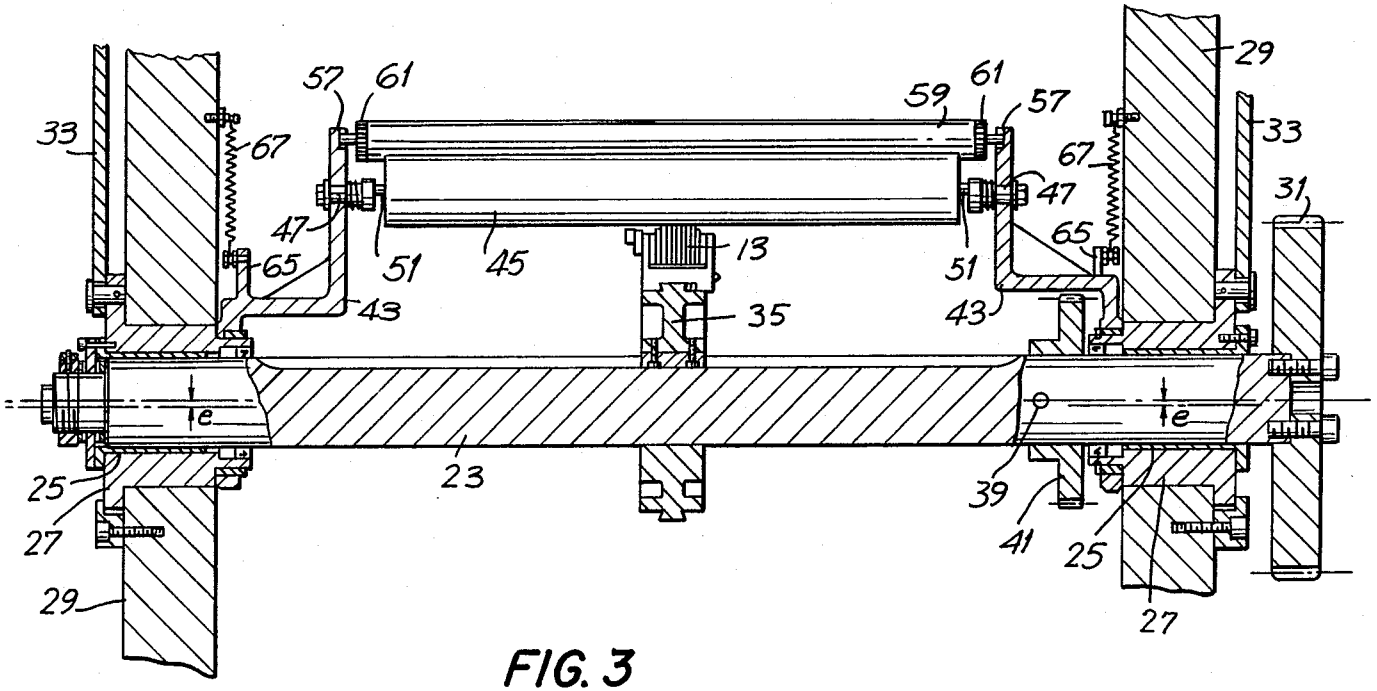
FIG. 3 is a vertical sectional view of a numbering shaft.

An embodiment of the present invention will now be described in detail with reference to the drawings. FIG. 1 is a schematic view showing part of a printing apparatus according to the present invention, FIG. 2 is an enlarged view of part of the printing apparatus according to the present invention, and FIG. 3 is a vertical sectional view of a numbering shaft of the printing apparatus.

Figure 4:
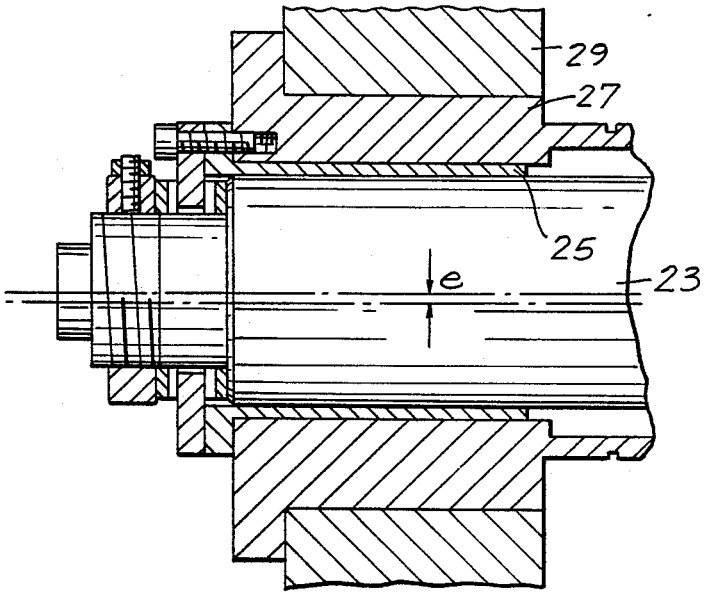
FIG. 4 is an enlarged sectional view of a supporting part of the numbering shaft.

In a main unit 19 of the printing apparatus, a numbering shaft 23, which is a printing shaft to perform number printing, is disposed in the vicinity of an impression cylinder 5. Referring to FIG. 3, the numbering shaft 23 is supported on both sides by eccentric bushings 27 through metal bearing 25, and each of the eccentric bushings 27 is supported by one of main unit frames 29. A driving gear 31 is fixed at one end of the numbering shaft 23, and the numbering shaft 23 is driven by a drive source (not shown) through the driving gear 31 to rotate synchronously with the impression cylinder 5. The eccentric bushings 27 are rotatably supported by the main unit frames 29 and, as shown in FIG. 4 which is an enlarged view of a supporting part of the numbering shaft 23, and have an eccentricity e between the center of the inner peripheral. Surface of the bushings 27 contacting the metal bearings 25 and the center of the circular arc of the outer peripheral surfaces contacting the main unit frames 29, thereby allowing movement of the axial center of the numbering shaft 23 by changing the phase angle of the eccentric bushings 27 through rods 33 mounted on the eccentric bushings 27. Thus, by turning the eccentric bushings 27, the numbering shaft 23 is moved and the distance between axial centers of the numbering shaft 23 and the impression cylinder 5 is adjusted to adapt it to the thickness of paper to be printed and withdrawal of the numbering shaft 23 in the event of a malfunction.

Figure 5:
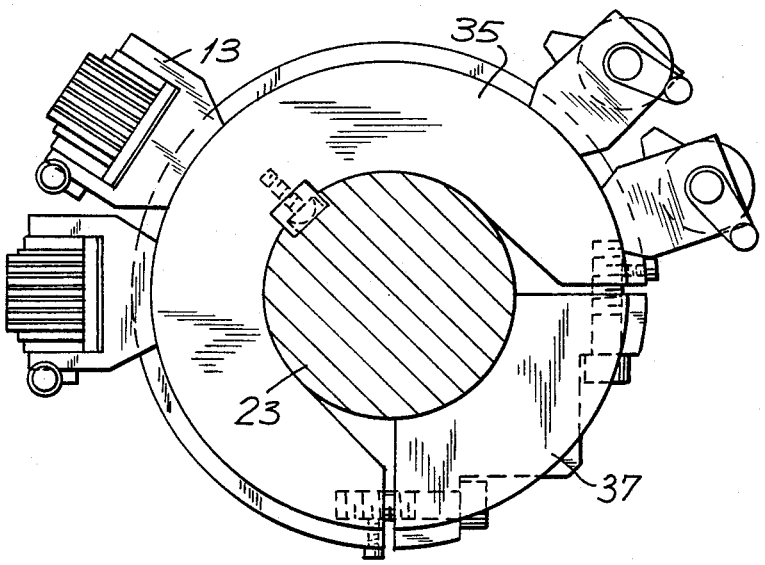
FIG. 5 is a side view of a numbering device.

On the numbering shaft 23 is mounted a numbering device 13 which is a printing member for number printing. The numbering device 13, the side view of which is shown in FIG. 5, is mounted on a mount 35 so that the postion of the numbering device 13 can be circumferentially adjusted. The mount 35 can be mounted at any axial position on the numbering shaft 23 so that the numbering shaft 23 is placed between the mount 35 and a mounting cap 37. Further, the numbering shaft 23 has gear 41 mounted detachably by a taper pin 39 so that when an ink feed unit which will be described herein later is mounted on the main unit 19 of the printing apparatus, the gear 41 engages a drive gear (not shown) of the ink feed unit 81 to drive the ink feed unit 81.

On the eccentric bushings 27 at both ends of the numbering shaft 23 bosses of levers 43 are rotatably mounted. The rotational centers of the lever 43 are aligned with the centers of inner peripheral arcs of the eccentric bushings 27, that is the rotational center of the numbering shaft 23. A form roller 45 is detachably mounted between the ends of the levers 43 so that the form roller 45 extends parallel to the numbering shaft 23 and is in rotatable contact with the outer peripheral surface of the numbering device 13. Referring to FIG. 6 which is an enlarged sectional view of the supporting part of the form roller 45 and FIG. 7 which is a sectional view taken along line VII—VII, on the levers 43 at their end holders 47 are mounted so that the rotational positions of the holders 47 are adjustable, a rotary shaft 51 of the form roller 45 is placed in grooves 49 formed in the holders 47, collars 55 are urged by springs 53 to prevent the rotary shaft 51 from coming out of the grooves 49, and thus the form roller 45 is supported by the levers 43. Positions of the bottoms of the grooves 49 of the holders 47 are shifted from rotational centers of the holders relative to the levers 43, and the mounting position of the form roller 45 relative to the levers 45 can be adjusted by changing the phase angle of the holders 47, and thereby the nip pressure of the form roller 45 to the numbering device 13 can be adjusted.

Figure 9:
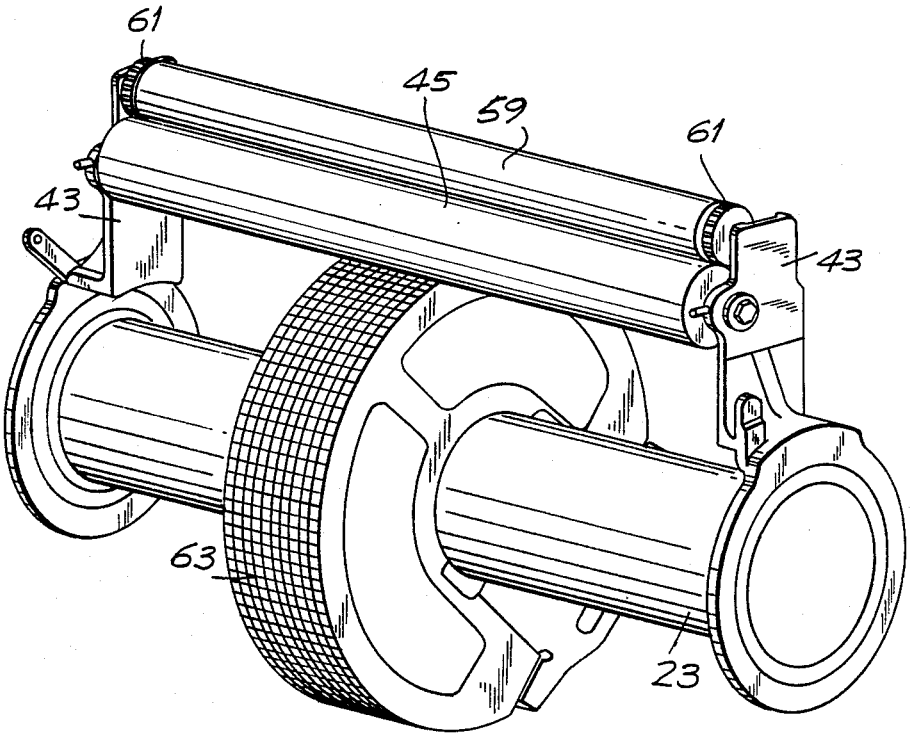
FIG. 9 is a perspective view showing the relative positions of the numbering shaft, the form roller, an ink retention roller and other components.

As shown in FIG. 3 and FIG. 8 which is an enlarged broken perspective view of part of FIG. 3, the levers 43 are provided at their ends with U-shaped grooves 57 on which the ends of an ink retention roller 59 are detachably mounted. The ink retention roller 59, when mounted on the grooves 57, is placed parallel to and on the form roller 45, and a nip pressure of the ink retention roller 59 to the form roller 45 is obtained from the weight of the ink retention roller 59 itself. The ink retention roller 59 is also provided at both of its ends with knurled knobs 61 to facilitate manual rotation. FIG. 9 is a schematic perspective view showing the relative positions of the numbering shaft 23, the ink retention roller 59, and other components. FIG. 9 shows an example in which a relief imprinting cylinder 63 in place of the numbering device 13 is mounted on the numbering shaft 23 as a printing shaft.

Figure 10:
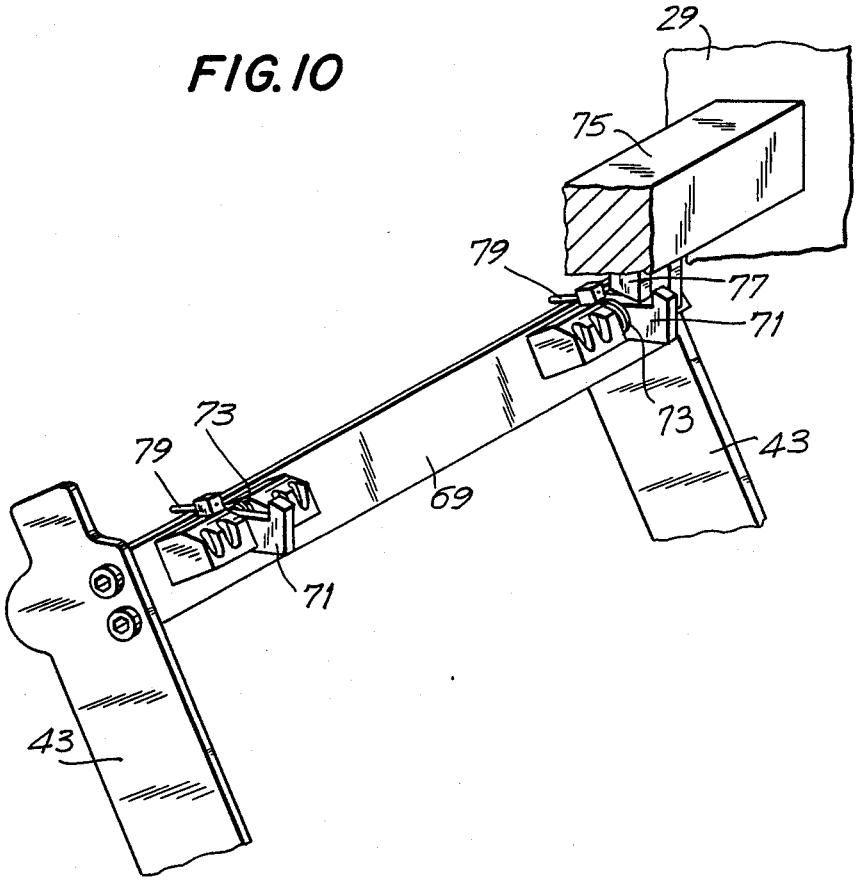
FIG. 10 is a perspective view of the ends of the levers.
Figure 11:
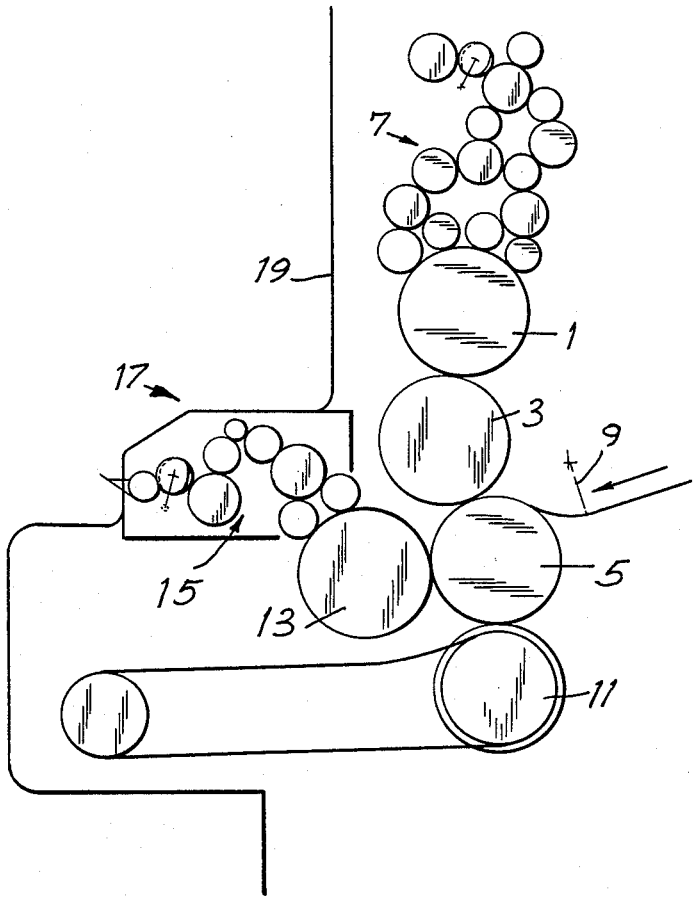
FIG. 11 PRIOR ART
FIG. 11 is a schematic view showing the structure of a prior art sheet-feed offset printing apparatus.
Figure 12:
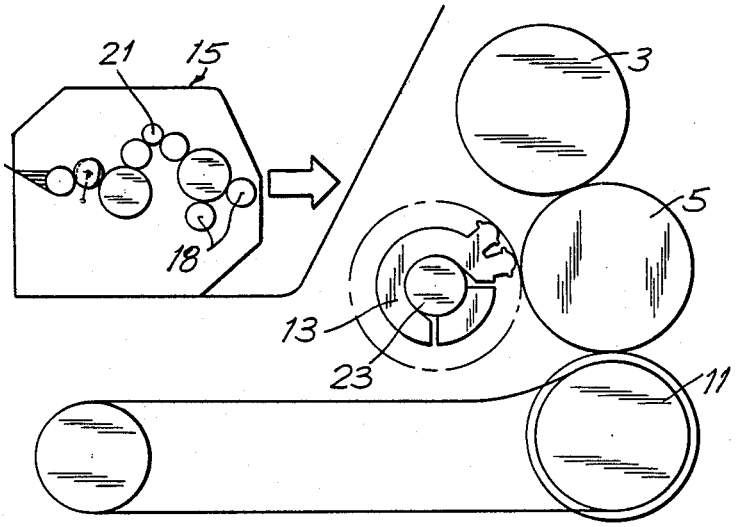
FIG.12 PRIOR ART
FIGS. 12 and 13 are schematic views explaining the removal of a prior art ink unit.
Figure 13:
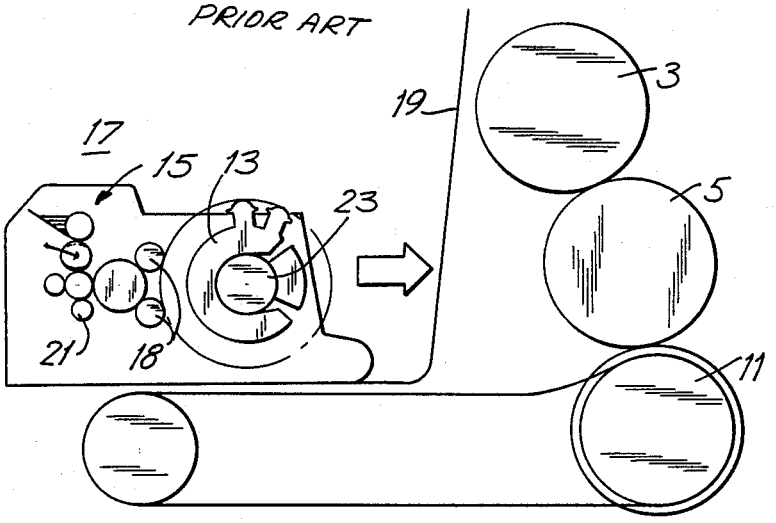
FIG.13 PRIOR ART

The bosses of the levers 43 are provided with projecting mounting pieces 65, and springs 67 are provided between the mounting pieces 65 and the main unit frames 29, and the levers 43 are urged counter-clockwise in FIG. 1 by the force of the springs so that the form roller 45 is pressed towards the ink feed unit 81. As shown in FIG. 10 which is a perspective view of the ends of the levers 43, a connecting plate 69 is mounted between the levers 43 on both sides, and the connecting plate 69 has a pair of claws 71 which are urged by torsion springs 73 so that the ends of claws 71 are directed upward. On a supporting rod 75 mounted between the main unit frames 29 in the vicinity of the claws 71, stopping pieces 77 which are engageable with the claws 71 are provided, and the rotation of the levers 43 urged by the springs 67 is limited when the claws 71 come into engagement with the stopping pieces 77. The claws 71 have operating pins 79 which can be rotated to turn the claws 71 against the force of the torsion springs 73 and release engagement of the claws 71 with the stopping pieces 77.

In FIG. 1 and FIG. 2, numeral 81 indicates the ink feed unit, which is provided separately from the main unit 19 of the printing apparatus and is detachably mounted on the main unit 19 of the printing apparatus using a conventional method known in the art. The ink unit 81 has an ink bottle 83, a fountain roller 85, an ink ductor roller 87, an intermediate distributor roller 89, a distributor roller 91 which rotatably contacts the form roller 45, and a drive gear mechanism (not shown) to drive these components. The ink unit 81 is detachably mounted on an opening of the main unit 19 of the printing apparatus provided, opposing the form roller 45. With the ink unit 81 mounted, the distributor roller 91 contacts the form roller 45, and the rollers 45 and 91 are pressed against each other with an adequate nip pressure provided by the springs 67.

With the above-described arrangement, printing operation is performed with the ink feed unit 81 mounted on the main unit 19 of the printing apparatus. Ink is supplied from the distributor roller 91 through the form roller 45 to the numbering device 13. In this case, when the axial center of the numbering shaft 23 is moved, for example, for adjustment to paper thickness, the relative positions of the numbering device 13 and the distributor roller 91 are varied, but the variation is absorbed by rotation of the levers 43. The nip pressure of the form roller 45 to the numbering device 13 is adjusted by turning the holders 47, and the levers 43 turn concentrically with the numbering shaft 23, thus the nip pressure is not affected by the turning of the levers 43.

Test printing can be carried out with the ink feed unit 81 removed from the main unit 19 of the printing apparatus. With the ink feed unit 81 removed, ink is applied onto the ink retention roller 59 or the form roller 45, the ink retention roller 59 is rotated to form the ink, and test printing is performed using the ink. Therefore, as a result of test printing, when the position of the numbering device 13 is to be changed, the change can be performed with a good workability since the ink feed unit is not mounted. The ink retention roller 59 is removed after the test printing is completed.

When it is desired to clean the impression cylinder 5 or other components, the ink feed unit 81 is removed, the springs 67 are removed and the claws 71 are disengaged from the stopping pieces 77, then the levers 43 are turned as indicated in FIG. 2 by the broken lines. This can provide an open space above the numbering device 13, thereby enabling easy cleaning.

We claim:

1. An inking device for use in a printing apparatus having a printing shaft disposed in the vicinity of an impression cylinder in a main unit bf the printing apparatus and driven to rotate in synchronization with said impression cylinder for printing by a printing member mounted on said printing shaft an object to be printed inserted between said impression cylinder and said printing member, comprising a form roller mounted in said main unit of the printing apparatus on an axis parallel to said printing shaft and rotatably contacting with outer peripheral surface of said printing member, and an ink feed unit detachably mounted to said main unit of the printing apparatus and having a distributor roller rotatably contacting with outer peripheral surface of said form roller to supply said form roller with ink when said ink feed unit is mounted on said main unit of the printing apparatus said form roller remaining in contact with said printing member when said ink feed unit is detached from said main unit.

2. An inking device for a printing apparatus as claimed in claim 1, wherein said form roller is rotatably supported by levers having the same center of rotation as said printing shaft in said main unit of the printing apparatus, and further comprising springs for urging said levers in a direction to press said form roller against said distributor roller when said ink feed unit is mounted on said main unit of the printing apparatus.

3. An inking device for a printing apparatus as claimed in claim 1, further comprising an ink retention roller detachably disposed in parallel to said form roller and rotatably contacting with outer peripheral surface of said form roller to supply said form roller with ink.

4. An inking device for a printing apparatus as claimed in claim 2, wherein an ink retention roller rotatably contacting with the outer peripheral surface of said form roller for supplying said form roller with ink is detachably supported by said levers parallel to said form roller.

5. An inking device for a printing apparatus as claimed in claim 1, wherein said printing member is a numbering device for number printing.

6. An inking device for a printing apparatus as claimed in claim 1, wherein said printing member is a relief imprinting cylinder for imprinting.

* * * * *